US010959580B2

(12) United States Patent
Vegliante

(10) Patent No.: US 10,959,580 B2
(45) Date of Patent: Mar. 30, 2021

(54) NONWOVEN FABRIC DISPENSER

(71) Applicant: Paul Vegliante, Franklin Lakes, NJ (US)

(72) Inventor: Paul Vegliante, Franklin Lakes, NJ (US)

( * ) Notice: Subject to any disclaimer, the term of this patent is extended or adjusted under 35 U.S.C. 154(b) by 0 days.

(21) Appl. No.: 15/832,989

(22) Filed: Dec. 6, 2017

(65) Prior Publication Data

US 2019/0167047 A1 Jun. 6, 2019

(51) Int. Cl.

| | |
|---|---|
| ***A47K 10/36*** | (2006.01) |
| ***A47K 10/38*** | (2006.01) |
| ***B65H 35/00*** | (2006.01) |
| *A47K 10/32* | (2006.01) |

(52) U.S. Cl.

CPC ..... *A47K 10/3631* (2013.01); *B65H 35/0086* (2013.01); *A47K 2010/3266* (2013.01)

(58) Field of Classification Search

CPC ..... A47K 10/3631; A47K 10/36; A47K 2010/3266; B65H 35/0086; B65H 35/008; Y10T 83/896

See application file for complete search history.

(56) References Cited

U.S. PATENT DOCUMENTS

| | | | | |
|---|---|---|---|---|
| 1,827,029 | A | | 10/1931 | Marcalus |
| 2,115,891 | A | | 5/1938 | Tishler |
| 2,118,380 | A | | 5/1938 | Gresenz |
| 2,713,939 | A | | 7/1955 | Lear |
| 3,165,283 | A | | 1/1965 | Kaiser et al. |
| 3,549,066 | A | * | 12/1970 | Wankow ..... B65D 85/671 225/25 |
| 4,156,382 | A | | 5/1979 | Baker |
| D255,779 | S | | 7/1980 | Clatterbuck |
| 4,340,162 | A | | 7/1982 | Heiman et al. |
| 4,346,829 | A | | 8/1982 | Myers |
| 4,586,639 | A | | 5/1986 | Ruff et al. |
| D293,211 | S | | 12/1987 | DePaul et al. |
| 5,292,046 | A | | 3/1994 | Kaiser et al. |
| D347,345 | S | | 5/1994 | Kaiser et al. |
| 5,772,094 | A | | 6/1998 | Kaiser et al. |
| D396,978 | S | | 8/1998 | Kaiser et al. |
| 6,269,970 | B1 | | 8/2001 | Huang et al. |
| D447,685 | S | | 9/2001 | Chagnon et al. |

(Continued)

FOREIGN PATENT DOCUMENTS

| | | | | |
|---|---|---|---|---|
| CA | 2156643 A1 | | 2/1997 | |
| EP | 1475027 A2 | * | 11/2004 | ..... A47K 10/3836 |

(Continued)

OTHER PUBLICATIONS

Notice of Allowance dated Dec. 19, 2017, issued in connection with U.S. Appl. No. 29/585,274 (5 pages).

(Continued)

*Primary Examiner* — Stephen Choi

(74) *Attorney, Agent, or Firm* — McCarter & English, LLP

(57) ABSTRACT

A nonwoven fabric dispenser is provided with fixation elements attached to the body of the dispenser and a cutter assembly attached to a lid of the dispenser. Nonwoven fabric stock is secured by the fabric engagement structures when the lid of the dispenser is in a closed configuration and the cutter assembly is configured to separate a sheet of the nonwoven fabric stock of a desired length.

23 Claims, 8 Drawing Sheets

(56) References Cited

U.S. PATENT DOCUMENTS

| | | | | |
|---|---|---|---|---|
| D504,314 | S | 4/2005 | Kim | |
| D540,187 | S | 4/2007 | Duffy | |
| 7,406,904 | B2 | 8/2008 | Antal et al. | |
| 7,603,937 | B2 | 10/2009 | Pavlik et al. | |
| 7,918,151 | B2 | 4/2011 | Vegliante et al. | |
| 7,921,756 | B2 | 4/2011 | Vegliante et al. | |
| D643,747 | S | 8/2011 | Rye et al. | |
| D700,837 | S | 3/2014 | Antal, Sr. | |
| 8,684,228 | B2 | 4/2014 | Parker | |
| D727,170 | S | 4/2015 | Lokey et al. | |
| D728,258 | S | 5/2015 | Cohen | |
| D778,149 | S | 2/2017 | Frick | |
| 9,604,382 | B2 | 3/2017 | Vegliante et al. | |
| D787,324 | S | 5/2017 | Sotka | |
| D787,931 | S | 5/2017 | Beck et al. | |
| D815,522 | S | 4/2018 | Vegliante | |
| 2002/0023526 | A1 | 2/2002 | Vegliante et al. | |
| 2002/0056785 | A1 | 5/2002 | Newman et al. | |
| 2002/0117038 | A1 | 8/2002 | Vegliante et al. | |
| 2003/0127352 | A1 | 7/2003 | Buschkiel et al. | |
| 2003/0140760 | A1 | 7/2003 | Bory | |
| 2004/0237746 | A1 | 12/2004 | Schultz et al. | |
| 2005/0005755 | A1 | 1/2005 | Turvey et al. | |
| 2005/0035133 | A1 | 2/2005 | Gerulski et al. | |
| 2006/0202079 | A1 | 9/2006 | Pavlik | |
| 2006/0237579 | A1* | 10/2006 | Doubleday | A61F 15/002 242/595 |
| 2007/0000935 | A1 | 1/2007 | Pavlik et al. | |
| 2007/0044617 | A1 | 3/2007 | Pavlik | |
| 2008/0005882 | A1 | 1/2008 | Kaiser et al. | |
| 2008/0073371 | A1 | 3/2008 | Neiberger et al. | |
| 2008/0142379 | A1 | 6/2008 | Gnatenko | |
| 2009/0188366 | A1* | 7/2009 | Habra | B26D 1/065 83/614 |
| 2010/0032445 | A1 | 2/2010 | Bunoz | |
| 2010/0168685 | A1 | 7/2010 | Drown | |
| 2011/0209594 | A1 | 9/2011 | Withers | |
| 2011/0214544 | A1 | 9/2011 | Vegliante et al. | |
| 2012/0267387 | A1* | 10/2012 | Omdoll | A47K 10/32 221/1 |
| 2014/0096659 | A1 | 4/2014 | Choi | |
| 2015/0203313 | A1 | 7/2015 | Kaiser | |
| 2015/0239615 | A1 | 8/2015 | O'Donnell et al. | |
| 2015/0344256 | A1 | 12/2015 | Kaiser et al. | |
| 2016/0051330 | A1 | 2/2016 | Cosentino, II | |
| 2017/0151687 | A1 | 6/2017 | Vegliante et al. | |
| 2018/0141742 | A1 | 5/2018 | Vegliante | |
| 2018/0141743 | A1 | 5/2018 | Vegliante | |
| 2019/0168985 | A1 | 6/2019 | Vegliante | |

FOREIGN PATENT DOCUMENTS

| | | |
|---|---|---|
| JP | 1086937 | 4/1998 |
| JP | 200131077 A | 2/2001 |

OTHER PUBLICATIONS

Office Action dated Oct. 30, 2017, issued in connection with U.S. Appl. No. 29/585,274 (6 pages).

Plastic Wrap Dipenser Saran Wrap Cutter [online] Published on Oct. 14, 2014 from URL: https://wowbeli.com/plastic-wrap-dispenser-saran-wrap-cutter-poly-bags-cling-film-food-storage-containers-kitchen-accessories-supplies-products/ (8 pages).

Plastic Wrap Dispenser by ChicWrap [online] Retrieved Oct. 16, 2017 from URL: https://www.everythingkitchens.com/chicwrap-plastic-wrap-dispenser-modern-silver-dots-9914.html?utm_source=google&utm_medium=cse&utem_term=9914&gclid=EAlalQobChMl0_O9wZf11glVil6GCh1OXQCdEAQYCCABEgK_zPD-BwE (5 pages).

International Search Report of the International Searching Authority dated Jan. 30, 2018, issued in connection with International Application No. PCT/US2017/062770 (3 pages).

Written Opinion of the International Searching Authority dated Jan. 30, 2018, issued in connection with International Application No. PCT/US2017/062770 (8 pages).

Office Action dated Mar. 4, 2019, issued in connection with U.S. Appl. No. 15/832,953 (16 pages).

Written Opinion of the International Searching Authority dated Feb. 26, 2019, issued in connection with International Application No. PCT/US2018/64234 (4 pages).

Search Report of the International Searching Authority dated Feb. 26, 2019, issued in connection with International Application No. PCT/US2018/64234 (3 pages).

International Search Report of the International Searching Authority mailed on Feb. 27, 2019, issued in connection with International Application No. PCT/US2018/64241 (3 pages).

Written Opinion of the International Searching Authority dated Feb. 27, 2019, issued in connection with International Application No. PCT/US2018/64241 (9 pages).

Office Action dated Jun. 5, 2019, issued in connection with U.S. Appl. No. 15/399,863 (6 pages).

Office Action dated Jun. 5, 2019, issued in connection with U.S. Appl. No. 15/358,816 (7 pages).

Applicant-Initiated Interview Summary dated Jun. 12, 2019, issued in connection with U.S. Appl. No. 15/832,953 (9 pages).

Office Action dated Oct. 24, 2019, issued in connection with U.S. Appl. No. 15/358,816 (8 pages).

Office Action dated Nov. 21, 2019, issued in connection with U.S. Appl. No. 15/832,953 (20 pages).

Notice of Allowance dated Sep. 20, 2019, issued in connection with U.S. Appl. No. 29/656,548 (11 pages).

Applicant-Initiated Interview Summary dated Nov. 12, 2019, issued in connection with U.S. Appl. No. 15/358,816 (2 pages).

Office Action dated Dec. 19, 2019, issued in connection with U.S. Appl. No. 15/358,816 (7 pages).

Office Action dated Dec. 20, 2019, issued in connection with U.S. Appl. No. 15/399,863 (9 pages).

Examiner-Initiated Interview Summary dated Dec. 19, 2019, issued in connection with U.S. Appl. No. 15/399,863 (3 pages).

* cited by examiner

NONWOVEN FABRIC DISPENSER

FIELD

The present disclosure relates to a nonwoven fabric dispenser and, in particular, to a nonwoven fabric stock dispenser including a container, a cutter assembly, and fabric engagement structures.

BACKGROUND

Nonwoven fabrics are sheet or web structures made from entangled fibers that are bonded together and can exhibit characteristics such as absorbency, resilience, stretch, softness, and strength. Nonwoven fabric stock can be provided with liquid solutions for various applications (e.g., wet wipes, towelettes, conditioning wipes, protectant wipes, etc.) and are stored in, and dispensed from, containers in various ways. Some forms of nonwoven fabric stock are provided as individual sheets, while others are provided as a continuous roll having perforations and can be pulled out of a container having a necked opening.

What is needed, but has not yet been developed, are methods and devices for dispensing nonwoven fabric stock materials. This and other needs are addressed by the nonwoven fabric dispensers of the present disclosure.

SUMMARY

In accordance with some aspects of the present disclosure, a nonwoven fabric dispenser is provided. The dispenser includes a body having a front wall, a rear wall, a bottom wall, side walls, a support wall, and a lid. The front wall, rear wall, bottom wall, support wall, lid, and side walls could form an enclosure configured and dimensioned to receive a roll of nonwoven fabric stock. A cutter assembly could be positioned on the lid. The cutter assembly could include an elongated slot disposed through the lid and a slidable base having a blade. The slidable base travels along the slot to cut nonwoven fabric stock positioned between the lid and the support wall. One or more fabric engagement structures could be disposed on the support wall and/or on the lid to hold a sheet of nonwoven fabric stock in place while the sheet is being cut from the roll. An opening for dispensing the nonwoven fabric stock is exposed when the dispenser is in the open configuration and covered when the dispenser is in a closed configuration.

In accordance with some aspects of the present disclosure, a method for dispensing nonwoven fabric stock from the dispenser is provided. The method can include dispensing the nonwoven fabric stock from the dispenser, drawing the nonwoven fabric stock over the one or more fabric engagement structures, closing the lid on top of the nonwoven fabric stock, thereby securely holding the nonwoven fabric stock in place, and using the cutter assembly to separate a single sheet of nonwoven fabric stock. The nonwoven fabric stock is securely held in place by the fabric engagement structures and tension is maintained on the nonwoven fabric stock to allow the slidable cutter to easily and cleanly cut therethrough.

BRIEF DESCRIPTION OF THE DRAWINGS

To assist those of skill in the art in making and using the disclosed nonwoven fabric dispenser, reference is made to the accompanying figures, wherein.

DETAILED DESCRIPTION

It should be understood that the relative terminology used herein, such as "front", "rear," "left," "top," "bottom," "vertical," and "horizontal" is solely for the purposes of clarity and designation and is not intended to limit the invention to embodiments having a particular position and/or orientation. Accordingly, such relative terminology should not be construed to limit the scope of the present invention. In addition, it should be understood that the invention is not limited to embodiments having specific dimensions.

Figure 1:
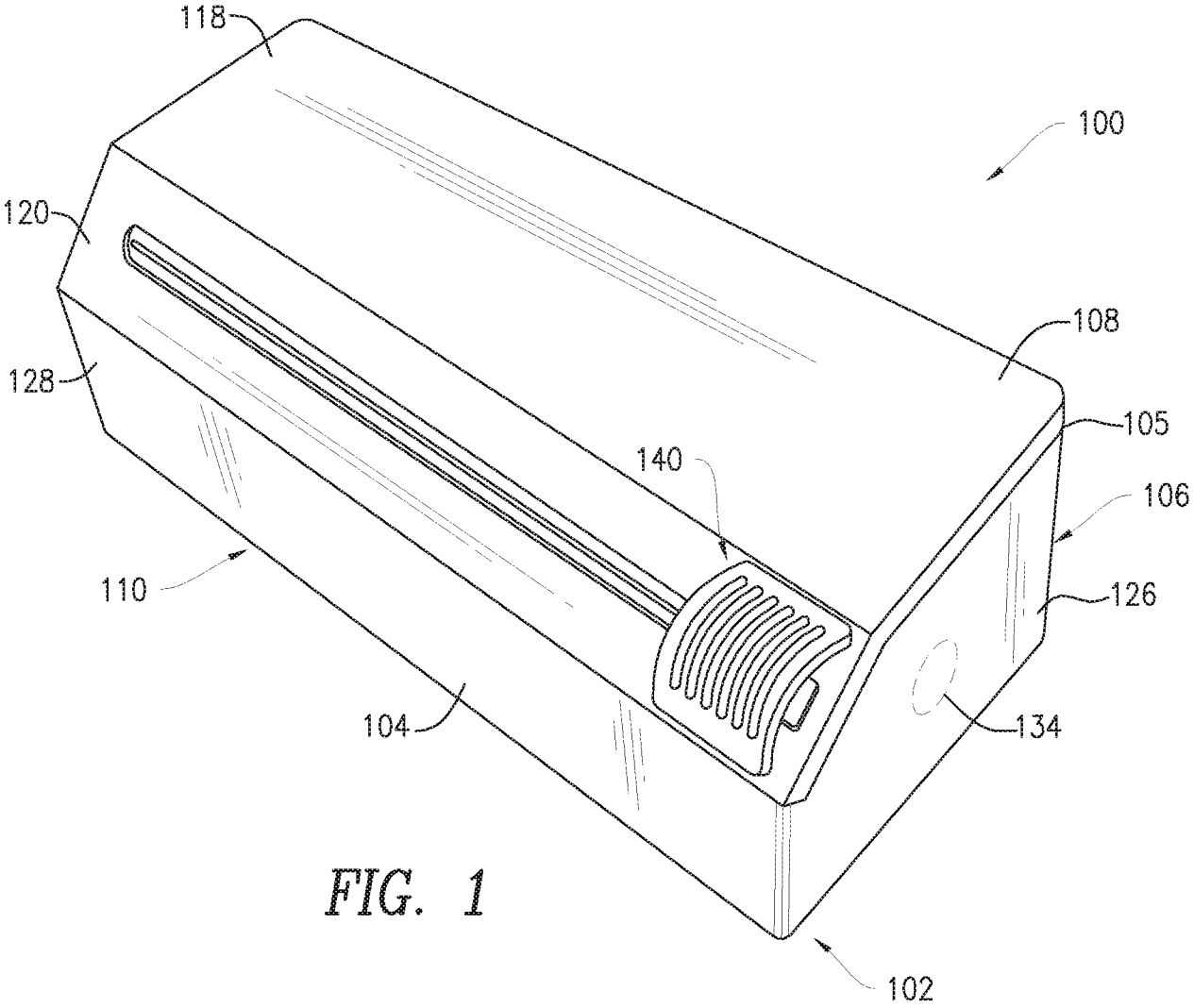
FIG. 1 is a perspective view of a nonwoven fabric dispenser according to the present disclosure.
Figure 2:
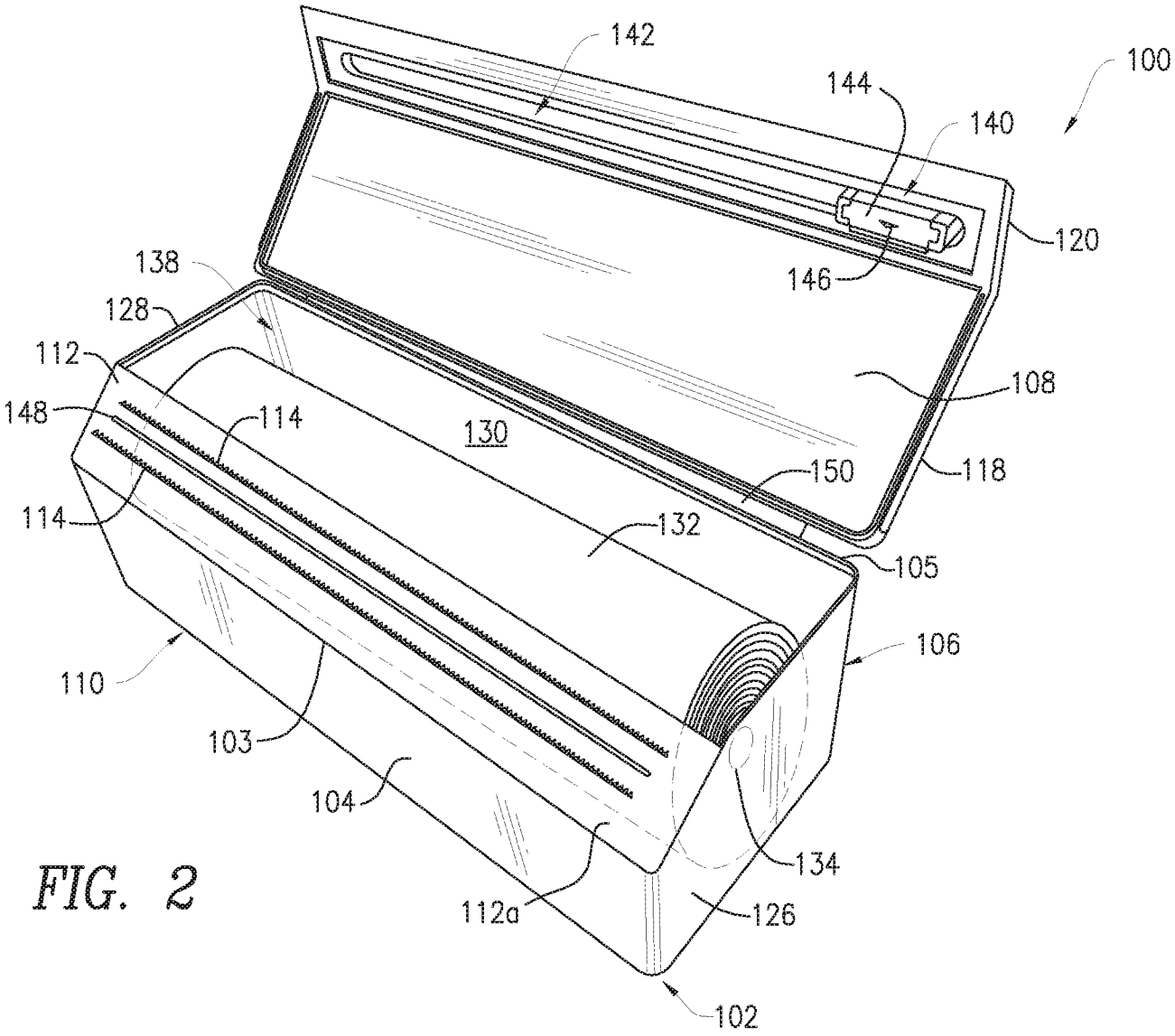
FIG. 2 is a perspective view of the nonwoven fabric dispenser of FIG. 1 in an open configuration.

FIGS. 1 and 2 show a nonwoven fabric dispenser (hereinafter "dispenser 100") according to the present disclosure. More specifically, FIG. 1 is a perspective view of the dispenser 100 in a closed configuration and FIG. 2 is a perspective view of the dispenser 100 in an open configuration. The dispenser 100 includes a body 102 including a front wall 104, a rear wall 106, a bottom wall 110, side walls 126, 128, a support wall 112, and a lid 108. In order to make the dispenser 100 particularly suitable for use with wet or moistened nonwoven fabric stock, the body 102 could be formed from any material (e.g., polymers, plastics, etc.) that is not permeable to moisture. The body 102 could be formed as a single monolithic component (e.g., by injection molding, blow molding, or the like) or the body could be formed from multiple components that are joined together (e.g., by gluing, bonding, welding, etc.) in separate manufacturing operations.

The first and second side walls 126, 128 and front, rear, and bottom walls 104, 106, and 110 form a receptacle for holding nonwoven fabric stock. The orientation of the first and second side walls 126, 128 and the front, rear, and bottom walls 104, 106, and 110 could comprise substantially right angles. Further, the height of the front wall 104 could be less than the height of the rear wall 106, and the support wall 112 could be joined to a top edge 103 of the front wall 104 and disposed at an angle relative thereto. The support wall 112 could be fixed in position or movable with respect to the top edge 103 of the front wall 104, described in greater detail hereinbelow with respect to FIG. 8.

As shown in FIGS. 1 and 2, the lid 108 could be joined to and extend from a top edge 105 of the rear wall 106, over support wall 112, and to the top edge 103 front wall 104. For example, as shown in FIG. 2, the lid 108 could be joined to the rear wall 106 by way of a living hinge 150 disposed therebetween. Alternatively, the lid 108 could be provided as a separate component that is configured to be in snap-fit engagement with the body 102. The lid 108 could have a first portion 118 and a second portion 120, the second portion 120 disposed at an angle relative to the first portion 118 and substantially matching the angle and geometry of the support wall 112. The front wall 104, rear wall 106, bottom wall 110, lid 108, support wall 112, and side walls 126, 128 form an enclosure 130 within the body 102 configured and dimensioned to receive a roll of nonwoven fabric stock 132. An opening 138 for dispensing and for replacing the nonwoven fabric stock 132 can be exposed when the dispenser 100 is in the open configuration and covered when the dispenser 100 is in a closed configuration.

According to some aspects of the present disclosure, the body 102 and the lid 108 of the dispenser 100 could be configured to be in snap-fit engagement, thereby providing a seal and preventing the drying out of moistened nonwoven fabric stock 132 during storage. For example, the lid 108 could be configured to be in snap-fit engagement with a perimeter of the opening 138 of the body 102 or the lid could be configured to be in snap-fit engagement with a perimeter of the opening 138 and the support wall 112. Additionally, the support wall 112 could be provided with a silicone or rubberized surface 112*a* to provide a better seal with the lid 108 and further aid in preventing the loss of moisture from the nonwoven fabric stock 132. According to aspects of the present disclosure, silicone or rubberized strips could be also disposed about at least a portion of a perimeter of the lid 108 to still further aide in preventing the loss of moisture.

As shown in FIG. 2, and described above, the second portion 120 of the lid 108 extends over the support wall 112. Either or both of the support wall 112 and the lid 108 (see FIG. 7) could have one or more fabric engagement structures 114, for maintaining the position of the nonwoven fabric stock 132 prior to cutting, described in greater detail hereinbelow. A retainer feature 134 could be provided to maintain the position of the roll of nonwoven fabric stock 132 within the enclosure 130 of the body 102. For example, the retainer feature 134 could be in the form of one or more cylindrical extensions provided on interior surfaces of side walls 126 and 128 and could be configured to be received within an interior of a carrier roll for the nonwoven fabric stock 132. The location of the feature 134, if included, defines the approximate axis of rotation for the nonwoven fabric stock 132.

The dispenser 100 includes a cutter assembly 140. As shown in FIG. 1, the cutter assembly 140 is attached to the lid 108 and includes an elongated slot 142 and a slidable base 144 housing a blade 146. The blade 146 could include a razor, serrated, or other edge configured for cutting through nonwoven fabric stock 132. The elongated slot 142 can be disposed through the lid 108 along the length thereof and the base 144 can be positioned within the slot 142 so that the base 144 can slide along the length of slot 142 to cut nonwoven fabric stock 132 positioned between the lid 108 and support wall 112. Further, as shown in FIG. 2, the support wall 112 could also be provided with a groove 148 for receiving the blade 148 when the lid 108 is in the closed position, thereby preventing damage to the blade 146. While shown including an elongated slot 142, a slidable base 144, and a blade 146, the cutter assembly 140 of the present disclosure can be provided in any desirable shape and configuration suitable for cutting nonwoven fabric and other similar materials.

As shown in FIG. 1, the cutter assembly 140 could fit within an area defined by the space under the intersection of the planes extending from the front wall 104 of the body 102 and the first portion 118 of the lid 108 when the lid 108 is in a closed position and thus does not extend beyond the bounds of the dispenser 100. Thus, the cutter assembly 140 is protected from damage during shipping or storage of the dispenser 100. Due to the recessed positioning of the cutter assembly 140, multiple dispensers 100 can be stacked relative to each other without imparting pressure or force on the cutter assembly 140, thereby preventing potential damage to the cutter assembly 140. This also allows the containers to be nicely positioned on store shelves, and stacked on store shelves, prior to sale.

Figure 3:
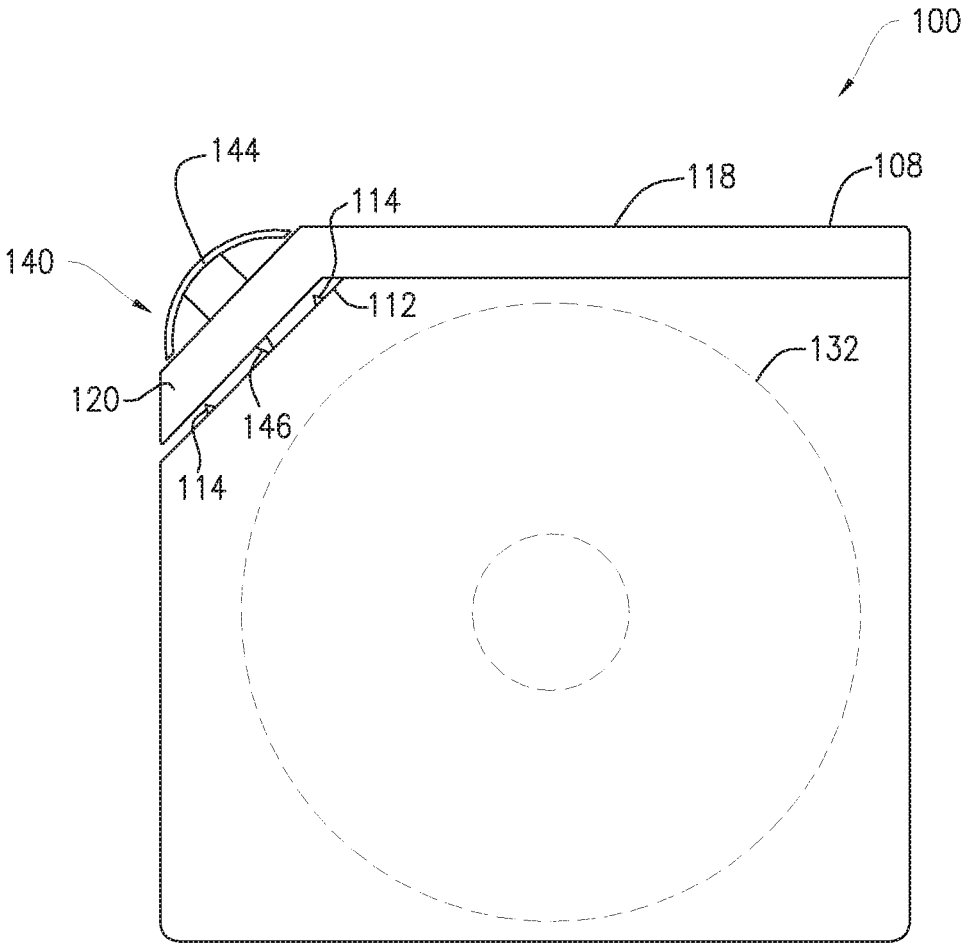
FIG. 3 is a side view of the nonwoven fabric dispenser of FIG. 1.

FIG. 3 is a side view of the nonwoven fabric dispenser 100 showing an exemplary arrangement of the fabric engagement structures 114 in relation to the cutter assembly 140 and more particularly to the slidable base 144 and blade 146. As shown in FIG. 3, one or more fixation elements 114 can be affixed to the support wall 112 of the dispenser 100. The fixation elements 114 could be disposed on either side of and positioned parallel to the groove 148. When the nonwoven fabric stock 132 is dispensed from dispenser 100, described hereinbelow in connection with FIGS. 4-6, the nonwoven fabric stock 132 is drawn over the one or more fabric engagement structures 114 (see FIG. 4) and the lid 108 is closed on top of the nonwoven fabric stock 132 (see FIG. 5), thereby forcing the stock onto the fabric engagement structures 114 to grip and securely hold the nonwoven fabric stock 132 in place while the slidable base 144 and blade 146 are used to separate a single sheet 162 of nonwoven fabric stock (see FIG. 6). Pressure applied to the slidable base 144 by a user pushes the lid 108 in a direction towards the support wall 112, thereby pushing the nonwoven fabric stock 132 into the fabric engagement structures 114 and engaging the nonwoven fabric stock 132 between the lid 108 and the fabric engagement structures 114. Importantly, because the nonwoven fabric stock 132 is securely held in place by the fabric engagement structures 114, tension is maintained on the nonwoven fabric stock 132, allowing the blade 146 of the cutter assembly 140 to easily and cleanly cut therethrough. For example, as shown in FIGS. 3-6, tension in the nonwoven fabric stock 132 material can be maintained between the fabric engagement structures 114, regardless of movement on either side of the fabric engagement structures 114 (e.g., either at the dispensed end or at the roll of stock 132). According to further aspects of the present disclosure, the fabric engagement structures 114 (or fabric engagement structures 214 shown in FIG. 7) could be disposed at an angle (e.g., 45 degrees) relative to the support wall and away from each other. Thus, when the lid 108 is closed over the fabric engagement structures 114 with the nonwoven fabric stock 132 disposed therebetween, the nonwoven fabric stock 132 between the fabric engagement structures 114 is tensioned further for improved cutting. Forming the fabric engagement structures 114 so that they are resiliently deformable will provide additional tension as they are deformed by pressure exerted on the lid 108 and further improved cutting of the nonwoven fabric stock 132 is achieved. The fabric engagement structures 114 could be made out of any material suitable for securely and removably holding the nonwoven fabric stock 132 while it is being cut.

According to some aspects of the present disclosure, the fabric engagement structures 114 could be formed from a series of upstanding serrated edges made of metal, plastic, or another material and disposed on the support wall 112 by glue, welding or the like to firmly secure the fabric engagement structures 114 to the container. According to other aspects of the present disclosure, the fabric engagement structures 114 could be a series of discrete pointed protrusions that are integrally formed with the support wall 112 during the manufacturing process. Importantly, forming the fixation elements 114 integrally with the support wall 112 eliminates manufacturing and assembly costs associated with separately manufacturing and then attaching the fixation elements 114 to the support wall 112. For example, fabric engagement structures 114 and support wall 112 could be formed from a single injection molding process. According to further aspects of the present disclosure, the fabric engagement structures 114 could be in the form of hooks of a hook and loop material (e.g., Velcro®). The fabric engagement structures 114 could be fingers that engage the nonwoven stock. The fabric engagement structures could also be formed from other materials capable of securely and removably engaging the fibers of the nonwoven fabric stock 132 without departing from the spirit and scope of the present disclosure.

Figure 4:
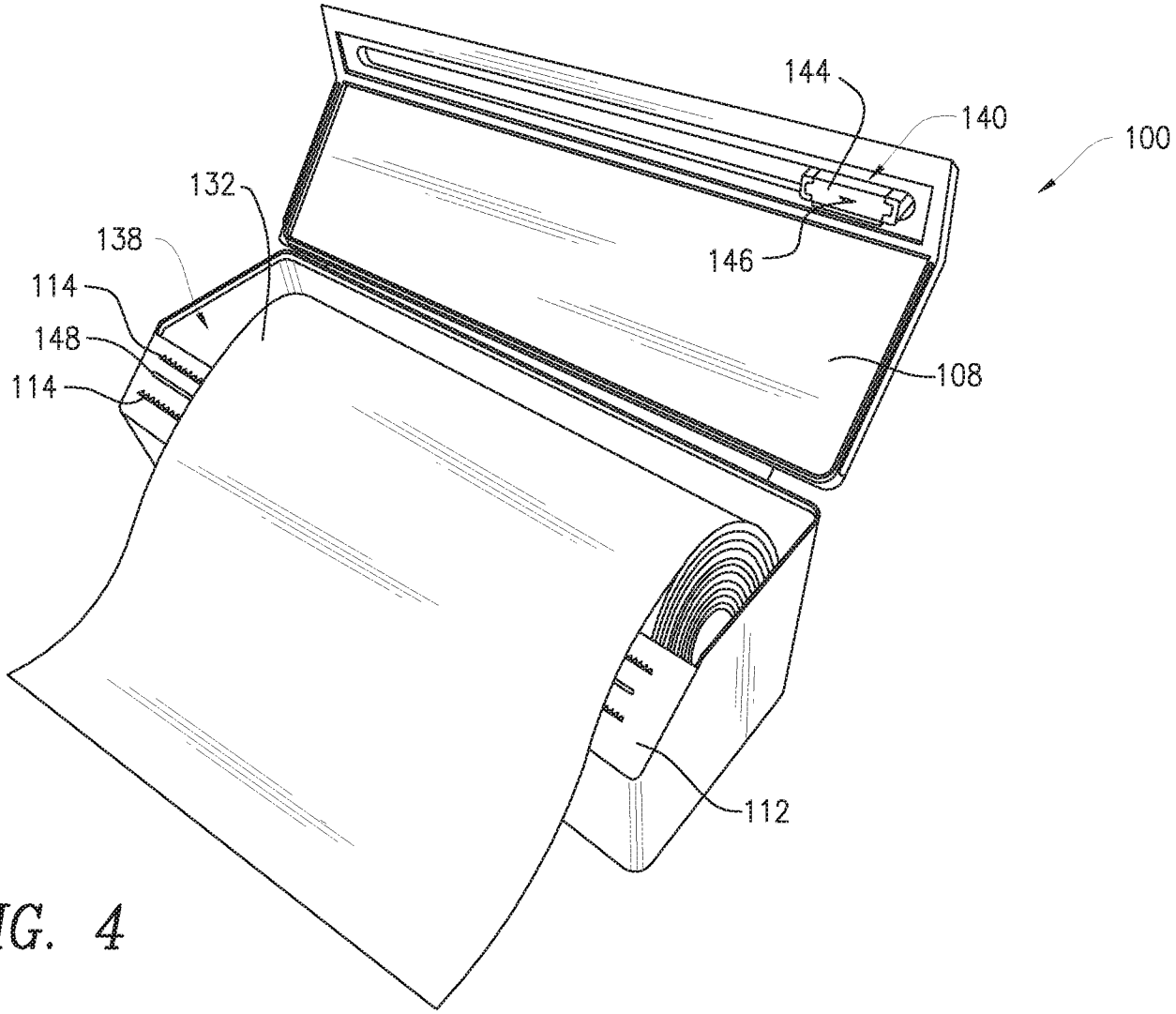
FIG. 4 is a perspective view of the nonwoven fabric dispenser of FIG. 1 in an open configuration with stock extending from the roll.
Figure 5:
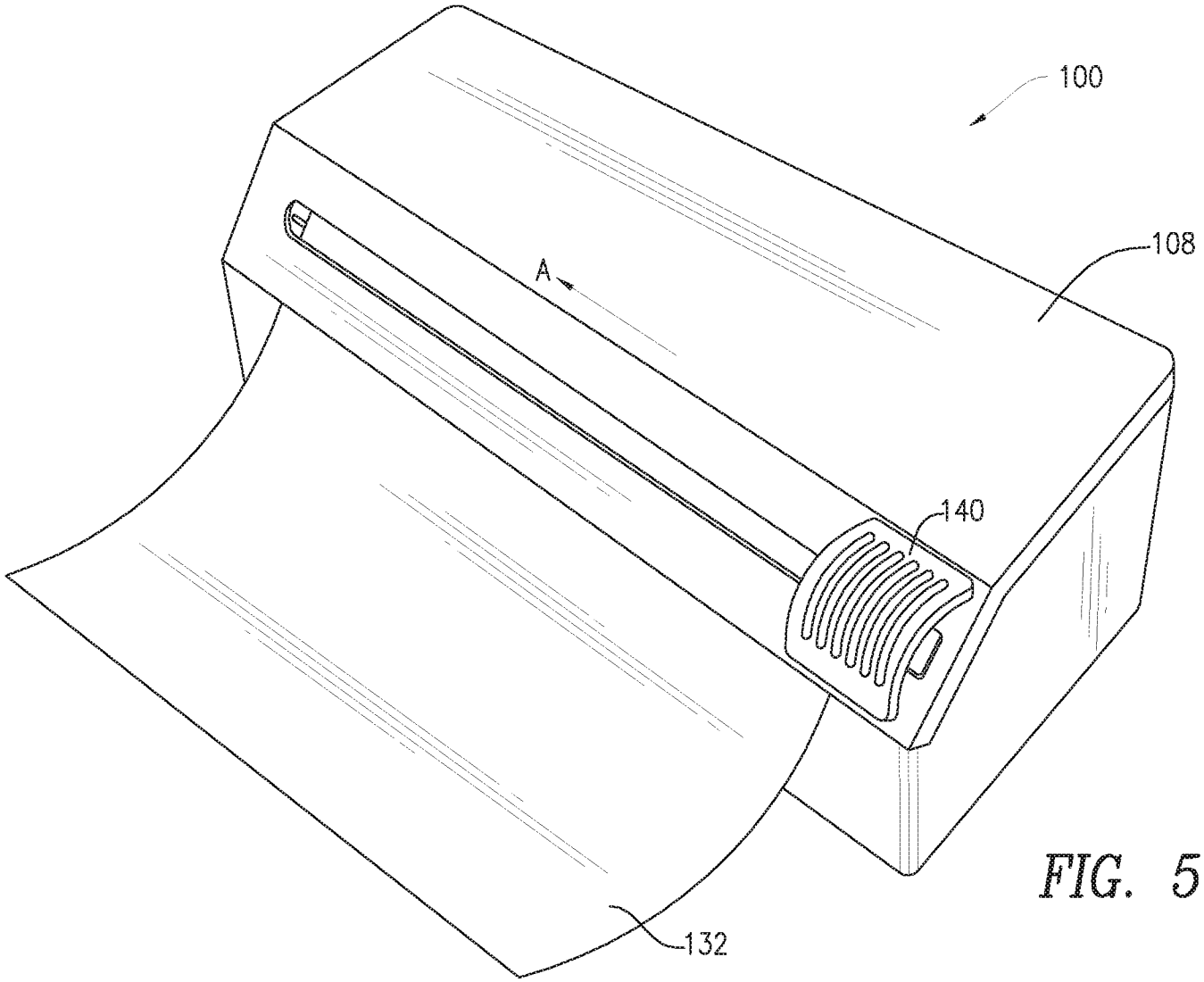
FIG. 5 is a perspective view of the nonwoven fabric dispenser of FIG. 4 in a closed configuration.
Figure 6:
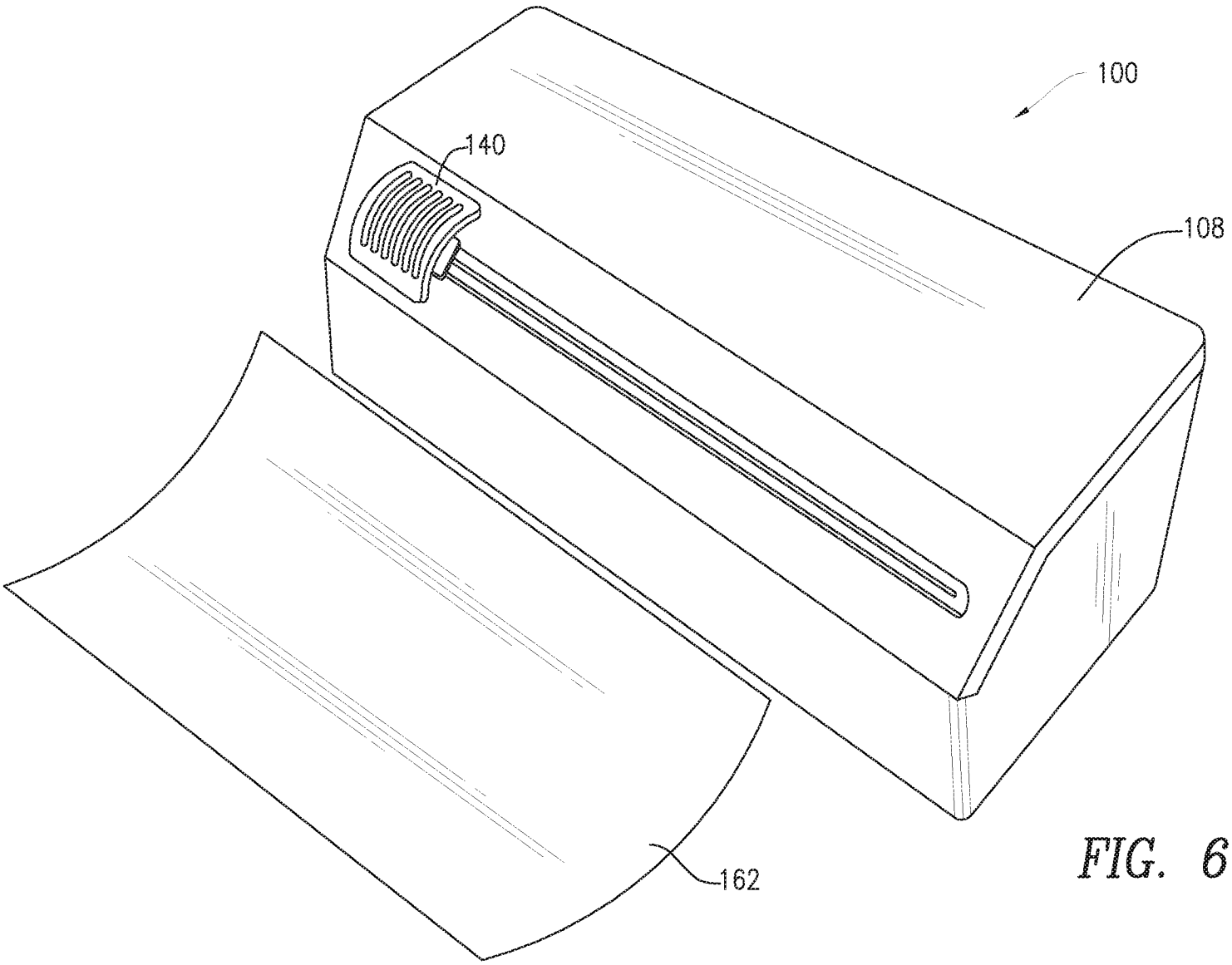
FIG. 6 is a perspective view of the nonwoven fabric dispenser of FIG. 5 after the cutter has been actuated to cut a section of the nonwoven fabric stock.

FIGS. 4-6 show operation of the nonwoven fabric dispenser 100 according to the present disclosure. More specifically, FIG. 4 is a perspective view of the nonwoven fabric dispenser 100 of FIG. 1 in an open configuration, thereby allowing for extension of the nonwoven fabric stock 132 through the opening 138. FIG. 5 is a perspective view of the nonwoven fabric dispenser 100 of FIG. 1 in a closed configuration showing the nonwoven fabric stock 132 extending from the dispenser 100. FIG. 6 is a perspective view of the nonwoven fabric dispenser 100 of FIG. 1 in a closed configuration showing a section 162 of the nonwoven fabric stock 132 being cut by the cutter assembly 140. As shown in FIG. 4, after raising the lid 108, an end of the nonwoven fabric stock 132 can be dispensed through the opening 138 until the desired length of the nonwoven fabric stock 132 is achieved. The nonwoven fabric stock 132 can be positioned over the one or more fixation elements 114 disposed on the support wall 112. The lid 108 can then be closed, thereby positioning the slidable base 144 and blade 146 of the cutter assembly 140 adjacent to, or into contact with, the nonwoven fabric stock 132 (see FIG. 5). When the nonwoven fabric stock 132 is drawn over the support wall 112 and the lid 108 is closed, the blade 146 can be received by the groove 148 and can make contact with the nonwoven fabric stock 132. The base 144 and blade 146 can then be drawn along the elongated slot 142 in the direction of arrow A (see FIG. 5) to sever a sheet 162 from the remaining nonwoven fabric stock 132.

According to further aspects of the present disclosure, the first portion 118 and the second portion 120 of the lid 108 could be hingedly coupled together. The first portion 118 of the lid 108 could be configured to be in snap-fit engagement with a perimeter of the opening 138, and the second portion 120 of the lid 108 could be configured to be in snap-fit engagement with a perimeter of the support wall 112. Accordingly, after severing a sheet 162 from the roll of nonwoven fabric stock 132 the second portion 120 of the lid 108 could be lifted to release the sheet 162, with the first portion 118 of the lid 108 remaining sealingly engaged with the perimeter of the opening 138, thereby minimizing the loss of moisture from the enclosure 130.

Figure 7:
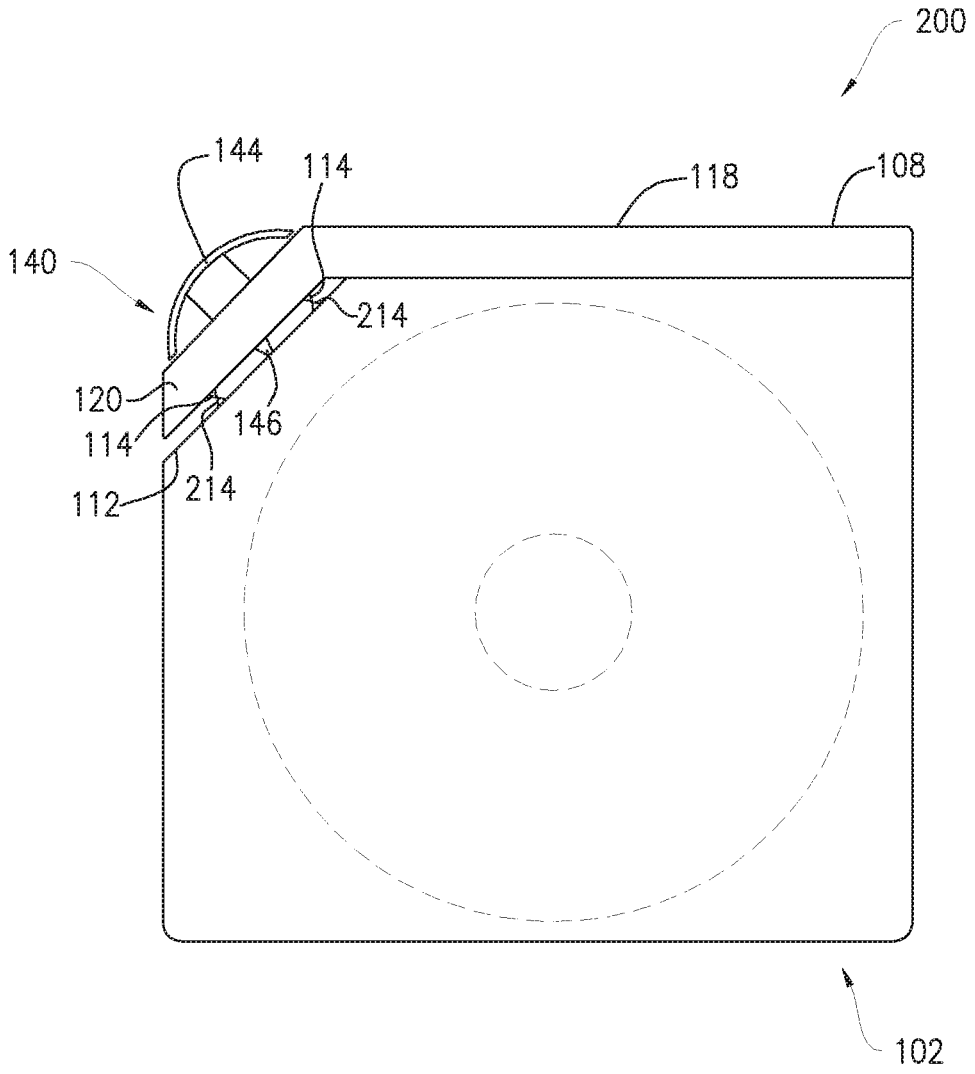
FIG. 7 is a side view of a nonwoven fabric dispenser according to the present disclosure including fabric engagement structures on both a lid and a support wall of the nonwoven fabric dispenser.
Figure 8:
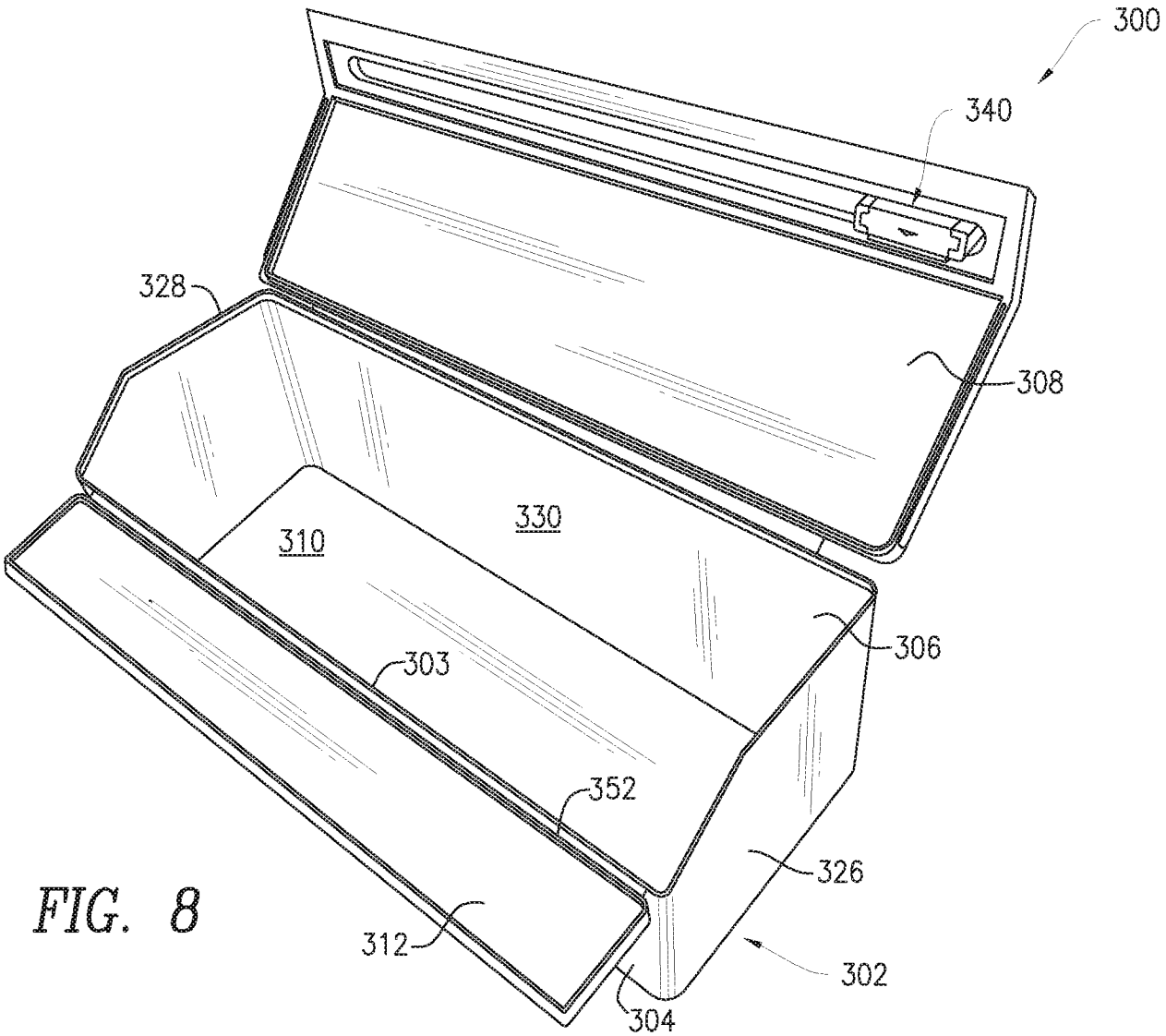
FIG. 8 is a perspective view showing another aspect of the nonwoven fabric dispenser according to the present disclosure.

FIG. 7 is a side view showing additional aspects of the nonwoven fabric dispenser according to the present disclosure including additional fabric engagement structures 214 positioned on the lid and support wall. More specifically, FIG. 7 shows another exemplary configuration of a nonwoven fabric dispenser 200 further including additional fabric engagement structures 214. The dispenser 200 can be substantially similar in structure and function to the dispenser 100, except for the distinctions noted herein. Similar to nonwoven fabric dispenser 100, dispenser 200 can include a body 102, a lid 108 having a first portion 118 and a second portion 120, a cutter assembly 140 having a slidable base 144 and blade 146, and fabric engagement structures 114 disposed on support wall 112. As shown in FIG. 7, the dispenser 200 could also include fabric engagement structures 214 disposed on an underside (e.g., the side adjacent to support wall 112 and fabric engagement structures 114) of the second portion 120 of the lid 108. The fabric engagement structures 214 could be provided on either side of, the elongated slot 142 of the cutter assembly 140. The top and bottom fabric engagement structures 214, 114 can be directly opposing or alongside the corresponding engagement structures. The fabric engagement structures can be linear or in a pattern. Accordingly, dispenser 200 provides fixation elements on both the top and bottom sides of the nonwoven fabric stock 132 (not shown) to further secure nonwoven fabric stock 132 as it is being cut in accordance with the steps described in connection with FIGS. 4-6. Fixation elements 214 could be formed in accordance with any of the examples described above in connection with fixation elements 114. Additionally, fixation elements 214 could be a series of discrete sharp protrusions disposed in a linear pattern that are integrally formed with the lid 108. Importantly, forming the fixation elements 214 integrally with the lid 108 eliminates manufacturing and assembly costs associated with separately manufacturing and then attaching the fixation elements 214 to the lid 108. For example, fixation elements 214 and lid 108 could be formed from a single injection molding process, or the like. FIG. 8. shows an exemplary nonwoven fabric dispenser 300 (hereinafter "dispenser 300") in accordance with some aspects of the present disclosure wherein the support wall is attached to the container along one edge by a living hinge. Dispenser 300 can be substantially similar in structure and function to dispenser 100, described hereinabove, except for the distinctions noted herein. Dispenser 300 allows the dispenser to accept a larger diameter roll of nonwoven fabric stock and simplifying the manufacturing process. As shown in FIG. 8, the dispenser 300 includes a body 302 having a front wall 304, a rear wall 306, a bottom wall 310, side walls 326 and 328, a support wall 312, and a lid 308 having a cutter assembly 340. Either or both of the support wall 312 and the lid 308 could have one or more fixation elements (not shown), for maintaining the position of the nonwoven fabric stock prior to cutting. The first and second side walls 326 and 328 and front, rear, and bottom walls 304, 306, and 310 form an enclosure 330 for holding nonwoven fabric stock. In order to accept rolls of nonwoven fabric stock having greater diameters than the width of opening 138 (see FIG. 2) of dispenser 100, the support wall 312 could be provided as a separate component that can be moved to provide additional access to the interior of enclosure 330. For example, as shown in FIG. 8, the support wall 312 could be joined to a top edge 303 of front wall 304 by way of a living hinge 352. According to other aspects of the present disclosure, a separate hinge (not shown) could be provided, or the support wall 312 could be configured for removable snap-fit engagement with side walls 326 and 328 and front wall 304. Further, providing support wall 312 as a separate or moveable component, can improve the manufacturing process by simplifying the geometries of an injection molding or blow molding process. For example, because the support wall 312 does not need to be positioned over the enclosure 330 during the manufacturing process, the body 302, lid 308, and support wall 312 could all be integrally formed during a single injection molding or blow molding process.

Each of the dispensers of the present disclosure can vary in shape and can include a face that is overlaid by a lid with a cutter assembly. The face can be on the support wall, described hereinabove, or on a vertical front wall, an angled wall, or a horizontal upper wall. The lid can have one or more portions and the cutter overlies the face. The nonwoven fabric stock is positioned between the lid and the face and is retained and/or tensioned by one or more fixation elements for cutting.

The present disclosure also contemplates a method for dispensing nonwoven fabric stock from a dispenser. The method includes the steps of opening a lid to access an opening in the body of the dispenser, drawing the nonwoven fabric stock out of the body through the opening and over a surface of the dispenser, closing the lid against the surface of the dispenser, pressing the lid against the surface of the dispenser to secure the nonwoven fabric stock between the lid and the surface by compressing the nonwoven fabric stock against one or more fixation elements, sliding the cutter along a length of the lid from a first position to a second position to cut through the nonwoven fabric stock, and separating a portion of the nonwoven fabric stock from the roll.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

What is claimed is:

1. A nonwoven fabric stock dispenser, comprising:

a body formed from a moisture impermeable material and including a front wall, a rear wall, a bottom wall, and first and second side walls forming an enclosure to receive a roll of nonwoven fabric stock, the rear wall having a greater height than the front wall;

a support wall joined to a top edge of the front wall;

a lid hingedly joined to a top edge of the rear wall, the lid having a first part extending over an opening in the body for dispensing the nonwoven fabric stock, and the lid having a second part extending over the support wall, wherein the body and the lid are configured to be in moisture impermeable engagement, thereby preventing moisture from escaping the enclosure;

a cutter disposed on the lid and movable along a path along the lid; and first and second upstanding serrated edges on one of the support wall or the lid, the first and second upstanding serrated edges positioned along both sides of the path of the cutter when the lid is in a closed configuration, the first and second upstanding serrated edges engaging the fibers of the nonwoven fabric stock and gripping the nonwoven fabric for cutting with the cutter.

2. The nonwoven fabric stock dispenser of claim 1, wherein the support wall includes a groove along the path of the cutter for receiving the cutter.

3. The nonwoven fabric stock dispenser of claim 1, wherein the first and second upstanding serrated edges tension the nonwoven fabric stock for cutting.

4. The nonwoven fabric stock dispenser of claim 1, wherein the first and second upstanding serrated edges are attached to the support wall.

5. The nonwoven fabric stock dispenser of claim 1, wherein the first and second upstanding serrated edges are disposed along the lid.

6. The nonwoven fabric stock dispenser of claim 1, further comprising opposing third and fourth upstanding serrated edges disposed on the other of the support wall or the lid in facing relation to the first and second upstanding serrated edges.

7. The nonwoven fabric stock dispenser of claim 1, wherein the support wall is hingedly attached to a top edge of the front wall of the body.

8. The nonwoven fabric stock dispenser of claim 7, wherein the body and the support wall are integrally formed and include a living hinge formed therebetween.

9. The nonwoven fabric stock dispenser of claim 1, wherein the body, the lid, and the support wall are integrally formed.

10. The nonwoven fabric stock dispenser of claim 1, further comprising a material selected to provide a seal disposed on a surface of the support wall proximate to the lid, the material, support wall, and lid configured to prevent moisture from escaping the enclosure.

11. The nonwoven fabric stock dispenser of claim 1, wherein the first and second upstanding serrated edges are metal.

12. The nonwoven fabric stock dispenser of claim 1, wherein the first and second upstanding serrated edges are positioned at an angle relative to the angled face and positioning the lid in the closed configuration forces the stock onto the first and second upstanding serrated edges and engages the fibers of the stock between the lid and first and second serrated edges, thereby tensioning the stock for cutting.

13. The nonwoven fabric stock dispenser of claim 12, wherein the first and second upstanding serrated edges are resiliently deformable.

14. A nonwoven fabric stock dispenser, comprising:

a body including an angled face, a rear wall, a bottom wall, and first and second side walls forming an enclosure to receive a roll of nonwoven fabric stock;

a lid joined to a top edge of the rear wall and when in a closed configuration, extending over an opening in the body for dispensing the nonwoven fabric stock, and extending over and parallel to the angled face, wherein the body and the lid are configured to be in moisture impermeable engagement, thereby preventing moisture from escaping the enclosure;

means for cutting the nonwoven fabric stock on the lid of the dispenser; and first and second upstanding serrated edges positioned along first and second sides of the means for cutting, the first and second upstanding serrated edges configured to engage the fibers of the nonwoven fabric stock to grip and tension the stock and to hold the stock between the lid and the angled face while it is being cut.

15. The nonwoven fabric stock dispenser of claim 14, wherein the means for cutting the nonwoven fabric stock includes a slidable cutter that extends through the lid.

16. The nonwoven fabric stock dispenser of claim 14, wherein the first and second upstanding serrated edges are provided on the angled face adjacent to the means for cutting the nonwoven fabric stock when the lid is in a closed configuration.

17. The nonwoven fabric stock dispenser of claim 14, wherein the first and second upstanding serrated edges are metal.

18. The nonwoven fabric stock dispenser of claim 14, wherein the first and second upstanding serrated edges are positioned at an angle relative to the angled face and positioning the lid in a closed configuration forces the stock onto the first and second upstanding serrated edges and engages the fibers of the stock between the lid and first and second serrated edges, thereby tensioning the stock for cutting.

19. The nonwoven fabric stock dispenser of claim 18, wherein the first and second upstanding serrated edges are resiliently deformable.

20. A nonwoven fabric stock dispenser, comprising:

a body formed from a moisture impermeable material and including a front wall, a rear wall, a bottom wall, and first and second side walls forming an enclosure to receive a roll of nonwoven fabric stock, the rear wall having a greater height than the front wall;

a support wall joined to a top edge of the front wall;

a lid hingedly joined to a top edge of the rear wall, the lid having a first part extending over an opening in the body for dispensing the nonwoven fabric stock, and the lid having a second part extending over the support wall, wherein the body and the lid are configured to be in moisture impermeable engagement, thereby preventing moisture from escaping the enclosure;

a cutter disposed on the lid and movable along a length the lid; and a plurality of discrete pointed protrusions disposed on the support wall extending along both sides of the path of the cutter when the lid is in a closed configuration, the pointed protrusions engaging the fibers of the nonwoven fabric stock and gripping the nonwoven fabric for cutting with the cutter.

21. The nonwoven fabric stock dispenser of claim 20, wherein the plurality of discrete pointed protrusions are molded into the support wall.

22. The nonwoven fabric stock dispenser of claim 20, wherein the support wall includes a groove along the path of the cutter for receiving the cutter.

23. The nonwoven fabric stock dispenser of claim 20, further comprising a second plurality of discrete pointed protrusions disposed on the lid in facing relation to the plurality of discrete pointed protrusions disposed on the support wall.

* * * * *